United States Patent [19]

Vaughn

[11] Patent Number: 4,768,530

[45] Date of Patent: Sep. 6, 1988

[54] TOILET CASE

[76] Inventor: Robert Vaughn, P.O. Box 874992, Wasilla, Ak. 99687-4992

[21] Appl. No.: 918,035

[22] Filed: Oct. 10, 1986

[51] Int. Cl.[4] ..... A45D 40/00

[52] U.S. Cl. ..... 132/79 R; 132/80 R; 206/581; 206/542; 206/823

[58] Field of Search ..... 132/79 R, 79 F, 79 G, 132/80 R, 80 A; 206/581, 542, 549, 574, 823; 220/4 C; 211/70, 39, 78

[56] References Cited

U.S. PATENT DOCUMENTS

| | | | |
|---|---|---|---|
| 1,248,284 | 11/1917 | Dickenson | 132/79 R |
| 1,683,851 | 9/1928 | Wells | 132/79 R |
| 1,990,439 | 2/1935 | Murphy et al. | 132/79 G |
| 2,295,347 | 9/1942 | Kelley | 132/79 G |
| 2,396,932 | 3/1946 | Slaton et al. | 132/79 R |
| 2,593,896 | 4/1952 | Kollontay | 132/79 R |
| 2,611,380 | 9/1952 | Grower | 132/80 R |
| 2,818,872 | 1/1958 | Wang | 132/80 R |
| 2,965,109 | 12/1960 | Borah | 132/80 R |
| 3,107,007 | 10/1963 | Klein | 132/79 R |
| 3,369,691 | 2/1968 | Wei | 206/549 |

*Primary Examiner*—Robert P. Swiatek
*Assistant Examiner*—Cary E. Stone
*Attorney, Agent, or Firm*—Michael J. Tavella

[57] ABSTRACT

A portable toilet case is disclosed that carries many common toilet items including razor, toothbrush, toothpaste, deodorant, etc. in retainer clips around a central pedestal. The retainer clips provide easy access to all of the toilet articles while providing a system to securely hold the items for storage. Three different embodiments of the invention are disclosed. The first is simply a carrier of the articles. The second, includes a removable storage unit that also has a mirror attached. The removable storage unit is sealed with a cap that can be used as a cup, and, in the case of a metal unit, can act as a cooking pot. The third embodiment also includes space for a small butane fueled camp stove. The device can be made of high strength plastic, or lightweight metals like aluminum.

10 Claims, 4 Drawing Sheets

FIG. 6
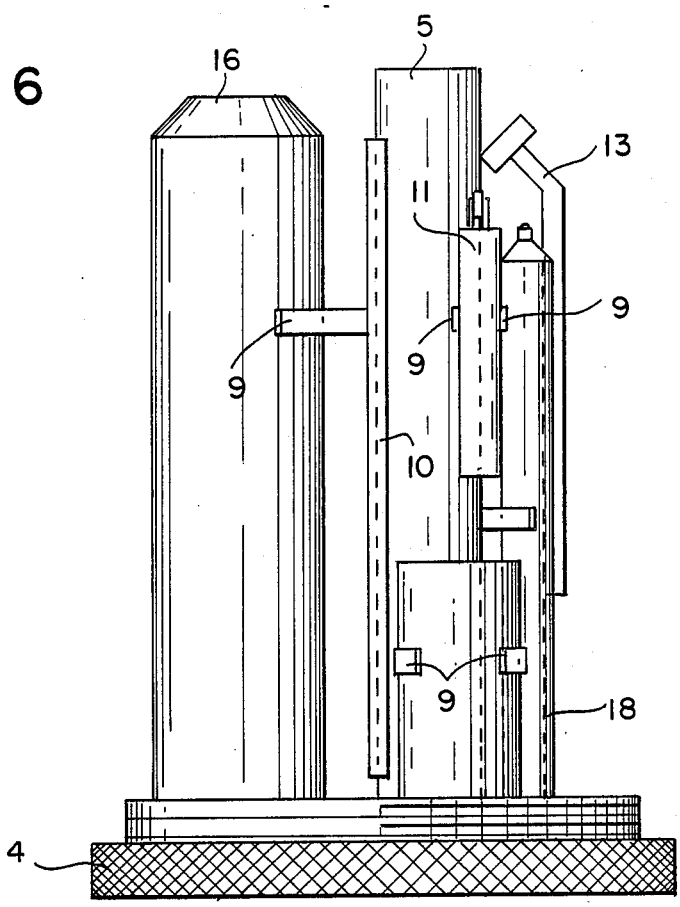
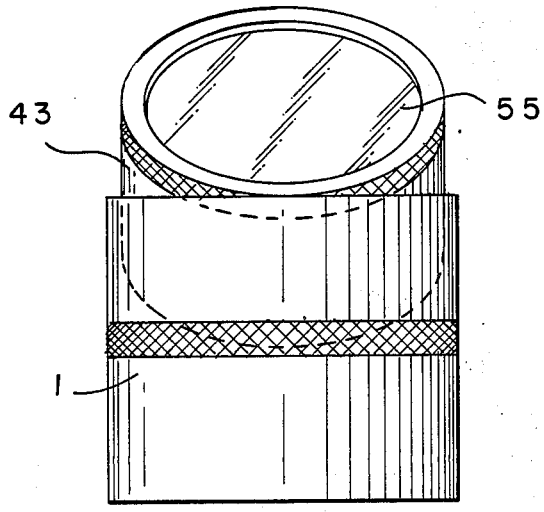
FIG. 7

FIG. 8a
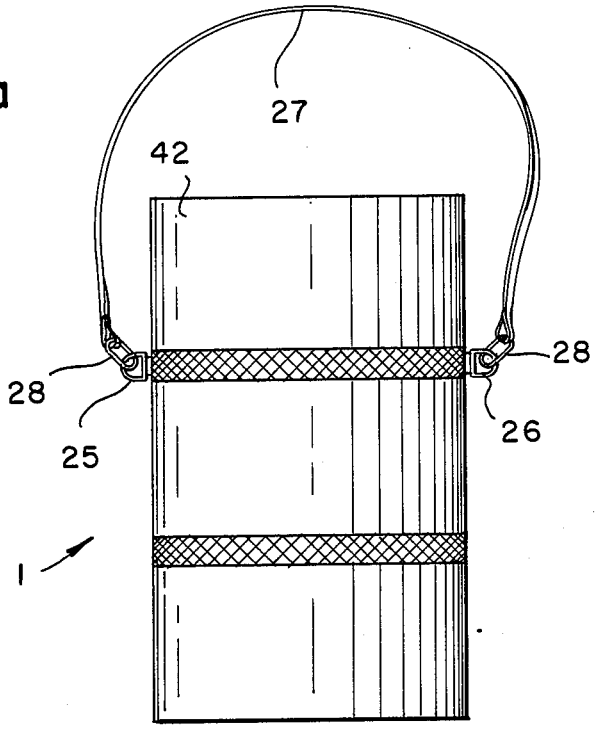
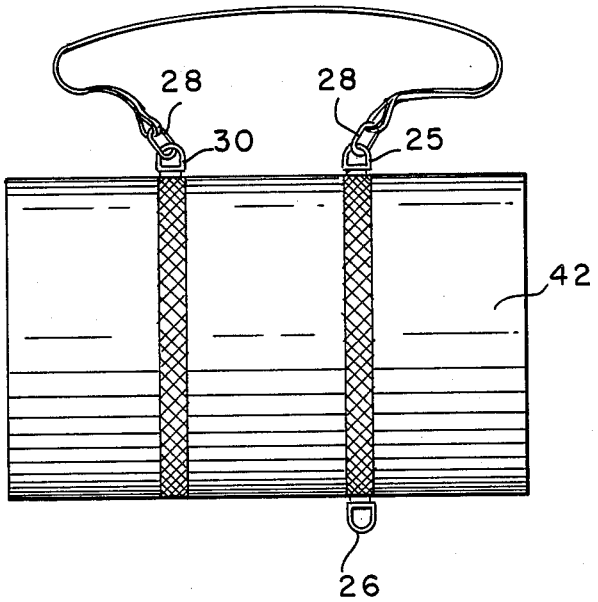
FIG. 8b

TOILET CASE

BACKGROUND OF THE INVENTION

This invention is related to toilet cases for portable use, and more particularly to toilet cases for outdoor field use as in camping or military applications.

Around the turn of the century and extending into the 1960's, many different designs for portable toilet cases were developed. In general, these devices had some means to secure specific toilet items. Some patents that illustrate these devices are U.S. Pat. Nos. 390,089 to McCelland, 1,069,117 to Deming, and 2,593,896 to Kollontay. All of these devices are designed for use by travelers that use traditional means of transportation such as airplanes and railroads, that stay in hotels.

The present invention goes beyond the simple toilet case as described in the patents listed above. It is intended to act as a holder of toilet articles in a remote field setting. The present invention is intended to be used by campers or by military personnal in the field. It is designed of aluminum, which can be used for cooking, or a lighter weight high strength plastic for backpacking use.

Three embodiments of the invention are disclosed. The first, consists of the essential toilet articles in a case. The second, consists of the same toilet articles with an additional unit on top. The second unit contains additional toilet articles, a cup, and a mirror. The third embodiment consists of the second embodiment with an additional unit that contains a portable butane cooking stove.

All of the units are provided with a carrying strap that can be adjusted to carry the device in an upright configuration.

The units also have a case made of canvas, or nylon, or other similar material, that can be fitted over the units. This cover can be made from camouflage material for military or hunting applications.

It is the object of the invention to produce a toilet case suitable for use in outdoor areas. It is a further object of the invention to produce a toilet case that can also be used to cook or heat water. It is a further object of this invention to provide a self contained unit that contains all necessary toilet articles, and can be used for cooking.

It is yet a further object of this invention to provide a self contained unit that contains all necessary toilet articles, can be used for cooking, and contains a cookstove.

BRIEF DESCRIPTION OF THE INVENTION

In its basic form, the invention consists of a cylindrical housing having a generally smooth surface. The housing is fitted with D-ring strap connectors that allow the user to carry it in a vertical position. The top of the housing is sealed. The inner portion of the bottom of the housing is threaded. These threads are used to engage the carrier, which is stored within the housing. The bottom of the carrier is sized to the same diameter of the housing. It is threaded to match the threads within the bottom of the housing. The outer surface of the carrier bottom is knurled to allow the user to grip the bottom portion.

The remaining portion of the carrier is primarily another cylinder of a smaller diameter then the housing, which acts as a pedestal. This pedestal is fastened to the bottom plate of the carrier. The pedestal is fitted with a number of spring clips (or similar fasteners) which are used to secure a number of common toilet items. The inside of the inner cylinder is hollow to allow writing paper to be stored inside of it.

A second embodiment of the invention consists of the components discussed above, with additional units attached to the housing. In this embodiment, the top of the housing is fitted with screw threads which are used to mate with an second carrier unit, which contains a hollow space to store additional items. This inner carrier unit also has a mirror mounted on the underside, which is glued to the housing. The lower portion of the second unit is also knurled to allow for a better grip. The inner carrier is also threaded to allow a cover to be placed over the inner unit. This cover can also be used as a cup. The top portion of this cover is also knurled.

A third embodiment is also disclosed which has a third cylinder added between the first housing and the second or top unit. The third cylinder has a space to carry a small Butane fired camp stove.

The invention may be made of aluminium or high strength plastics.

BRIEF DESCRIPTION OF THE DRAWINGS

FIG. 6 is a second detail view of the accessory pedestal along the lines 6—6.

FIG. 7 is a detail view of the mirror, showing it in position for use.

FIG. 8*a* is a side view of the device showing the first strap configuration.

FIG. 8*b* is a side view of the device showing the second, optional, strap configuration.

FIG. 9 is a detail view of a removable cover for the device, the figure depicts a cover designed to fit the second embodiment of the invention.

DETAILED DESCRIPTION OF THE INVENTION

Figure 1:
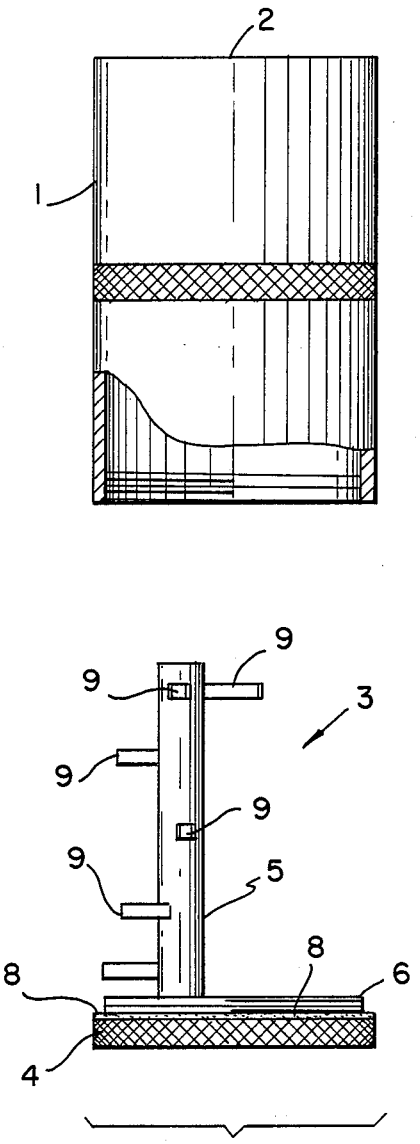
FIG. 1 is an exploded view of the first embodiment.

Referring now to the drawing figures, and more particularly, to FIG. 1, the simplest form of the invention consists of a housing 1, which is a cylinder. The housing 1 is sealed at the top end 2 forming a closed, watertight cover. A pedestal portion 3 is stored within the housing 1. The pedestal 3 has a base portion 4 and a support post 5. The base portion 4 is sized to the same diameter as the housing 1. The base portion 4 has a series of male screw threads 6 placed as shown. These threads mesh with a like set of female threads 7, which are cut into the bottom of the housing 1. A gasket 8 is placed on the base unit 4 to seal the housing 1, thereby making the assembly watertight.

Figure 5:
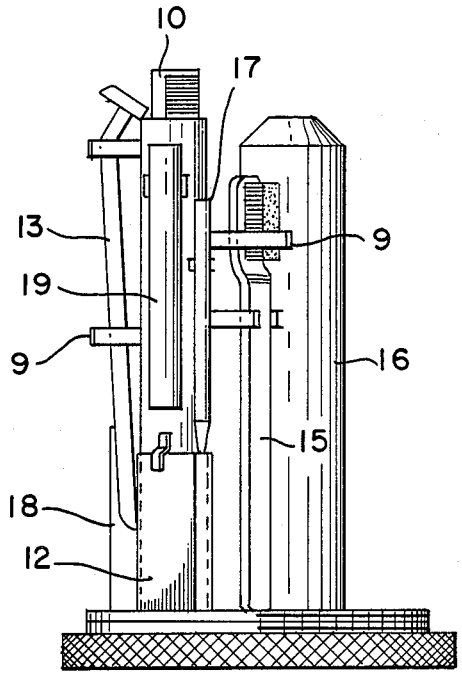
FIG. 5 is a detail view of the accessory pedestal along the lines 5—5.

The support post 5 is secured to the base portion 4 typically by welding. This post is fitted with a number of holding clips 9 (see FIG. 5). These holding clips 9 can be made of metal, rubber or plastic. However, other substitutes such as VELCRO patches or the like can also be used. Although, proper spacing must be maintained to allow all of the toilet items to be properly positioned around the pedestal. The holding clips 9 are used to hold a number of common toilet articles. In the preferred embodiment, these items are: a comb 10, a cigarette lighter 11 (a miniature butane type), razor blades 12, razor 13, deodorant 14, a toothbrush 15, a tube of toothpaste 16, a pencil or pen 17, a small flashlight 18, a small roll of toilet paper 19, and a quantity of writing paper 20, which is stored inside of the support post 5. The items are stored in specific locations around the support post 5. The clips 9 are located to allow all of the items to be placed around the storage post 5 in the most efficient manner and to ensure that the items are secured for use. Other clip arrangements are possible depending on the particular items to be stored and their dimensions. However, it is important that the clips are spaced to provide reasonable spacing for all of the particular items.

The basic design has two D-ring carriers 25, and 26 mounted as shown. The two D-rings 25 and 26 are mounted at the top of the device and are used to carry the device vertically. The device is carried with an adjustable strap 27 that is clipped in place with spring clips 28. The device can also be carried horizontally by removing the spring clip 28 from D-ring 25 and clipping it into an optional D-ring 30. The optional D-ring 30 is not used in the preferred embodiment.

As shown in the drawings, the outer surface of the housing 1 containes a knurled surface around its central circumference. The outer portion of the base unit 4 is knurled also. This knurling provides a good gripping surface under many field conditions and is useful when the base unit 4 is being unscrewed.

Figure 2:
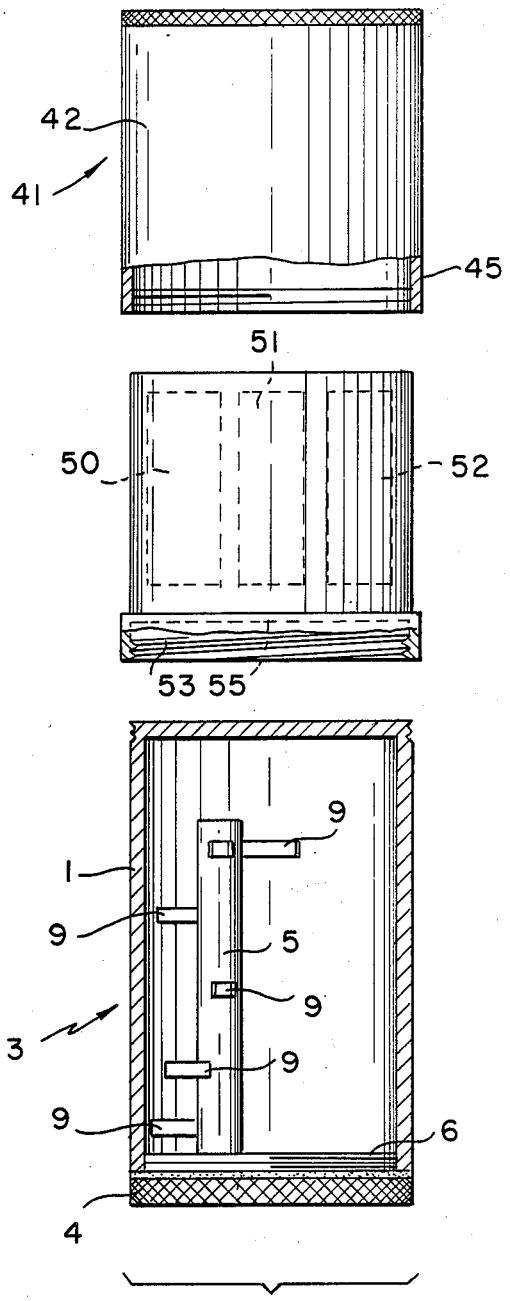
FIG. 2 is an exploded view of the second embodiment.

The second embodiment of the invention contains the internal features of the first. However, the top of the housing 1 is now provided with a threaded portion 40 which is used to secure the upper unit 41 to the housing 1. This is best shown in FIG. 2. The upper unit 41 has two main parts. The cup portion 42 and the mirror portion 43. The cup portion 42 is a cylinder much like the housing 1 only smaller. It is sealed at the top. The bottom of the housing is fitted with a female thread 45 which is used to connect the mirror portion 43 to the cup portion 42.

The mirror portion 43 is swaged from the bottom to the top. The upper portion acts as a storage area for things like soap 50, a washrag 51, and a small sewing kit 52. The bottom of the mirror portion 43 is fitted with a female thread 53 which connects to the male thread on the top of the housing 1. A mirror 55 is fitted into the surface of the bottom of the mirror portion 43 as shown.

As in the case of the first embodiment, the cup portion 42 and the mirror portion 43 are provided with knurled portions as shown which provide a better grip when the components are being unscrewed.

Figure 3:
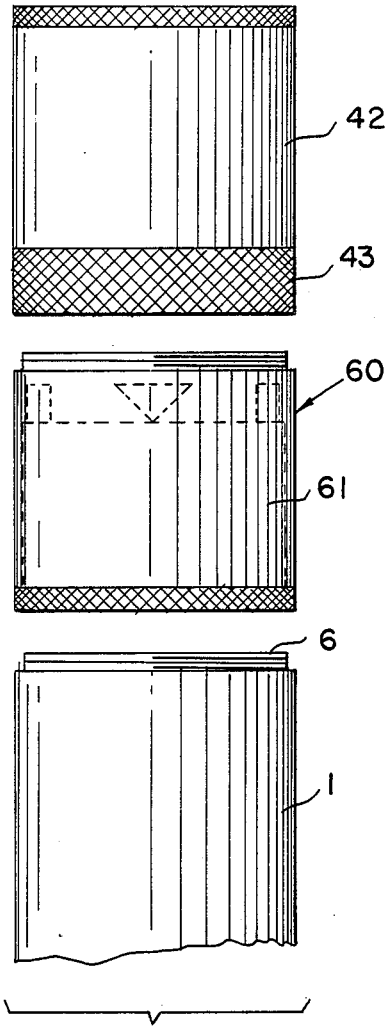
FIG. 3 is an exploded view of the third embodiment.
Figure 4:
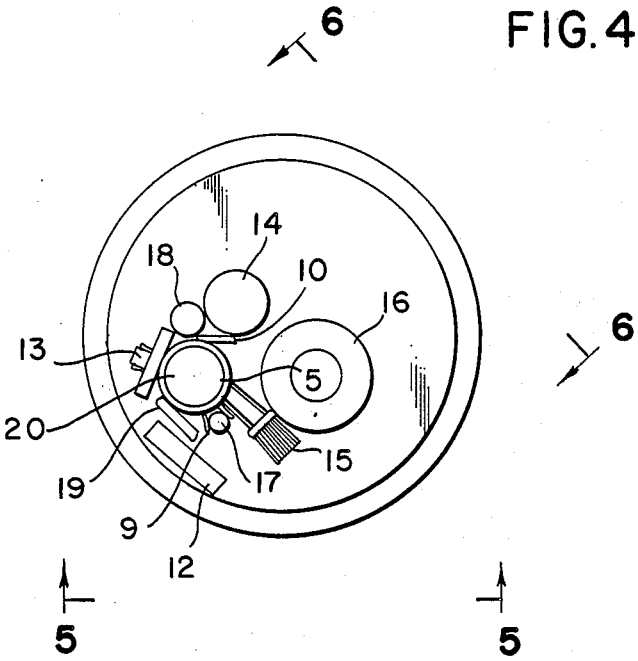
FIG. 4 is a top view of the accessory pedestal.

FIG. 3 shows the third embodiment of the invention. Essentially, this embodiment contains all of the features of the second embodiment with the addition of an additional storage cylinder 60. This cylinder 60 is similar to the design of the cup 42. It is hollow and is used to carry a small butane fueled camp 61 stove. The storage cylinder 60 is designed to fit in between the housing unit 1 and the mirror portion 43. As in the case of the second embodiment, the cup portion 42 seals the mirror portion 43. Also, as in the case of the other cylindrical modules, the storage cylinder 60 is provided with a knurled surface to ensure a firm grip when the cylinder is unscrewed.

All three embodiments are provided with covers 70 (the cover is sized to fit the appropriate embodiment, the figure shows a representative cover that will fit the second embodiment). The cover 70 is fitted with VELCRO or similar closures. The cover 70 is also provided with openings that correspond to the D rings in the lower housing unit 1 to allow the strap to be connected and disconnected without having to remove the cover. The cover can be colored in many different shades, including camuflauge for military applications.

In all embodiments, gaskets 8 are placed at all thread flanges to ensure a water-tight seal is formed between different units.

Although three embodiments are disclosed, the second embodiment is considered to be the preferred embodiment.

The device can be manufactured with stainless steel components, hard impact plastic, or both. Of course, plastic components cannot be used for cooking.

USE OF THE INVENTION

The device is used in a number of different ways. In its basic form, the device can be carried into the field and opened as needed. Each item can be removed, used and then replaced in its retaining clip. The device can then be closed for storage.

In the second embodiment, a cup is provided (by using the top cover unit) that can be used for drinking, etc. In the case of a container made of metal, the top unit can also be used as a pot for cooking. The inner unit has a mirror attached to its lower surface. This can be held at a usable viewing angle by setting it at an angle within the lower housing unit as shown in FIG. 7.

The third embodiment of the invention can be used in the same manner as the second embodiment, except that the third embodiment also carries a portable stove, which can be used in the normal manner.

It is intended that the present disclosure should not be construed in any limited sense other than that limited by the scope of the following claims having regard to the teachings herein and the prior art being apparent with the preferred form necessary for the better understanding of the invention and may be subject to modification by skilled persons within the scope of the invention without departing from the concept thereof.

I claim:

1. A portable toilet case comprising:

A. a cylinderical housing having a end and a bottom end, said top end being generally flat and sealed forming a solid unit, said bottom end being open, said bottom end also having thread means formed therein, said housing being hollow forming an open container said top end also having thread means placed thereon to allow for connection of a second storage unit thereon;

B. a base portion also being cylinderical and having the same diameter as the bottom end of the housing, said base portion having opposite orientation thread means such that said bottom end of said housing will connect to said base portion;

C. pedestal means also being cylinderical, said pedestal means having smaller diameter that said base portion and being fixedly mounted thereon, said pedestal means also having a lesser height that the inner portion of the housing so that said pedestal means will fully fit within said housing when said base portion is fully engaged with said housing;

D. retaining clip means, fixedly mounted to said pedestal means and arranged thereon to accept a plurality of toilet items;

E. a plurality of toilet item means interspersed about said pedestal means and retained thereon by said retaining clip means, F. a second storage unit, said second storage unit having a base unit sized to match the diameter of the top end of the housing and having thread means placed on the inner circumference of the base unit such that said base unit will connect with the thread means placed on the top end of said housing, said second storage unit having a cylinderical storage area that is hollow to store additional toilet means, said second storage unit also having a second thread means placed around the outer face of said second base unit to allow connection of a cap unit;

G. cap means, also cylindrical and sized to fit on top of said second storage unit and form a cover therefore, said cap means also being hollow, said cap means also having thread means located at the bottom of said cap means to connect to the second thread means on said second storage unit.

2. The toilet case of claim 1 wherein said retaining clip means are metal spring clips.

3. The toilet case of claim 1 wherein said toilet item means comprise a comb, a cigarette lighter, razor blades, a safety razor, a deoderant stick, a toothbrush, a tube of toothpaste, a pencil, a small flashlight, a small roll of toilet paper, and a quantity of writing paper.

4. The toilet case of claim 1, further comprising strap connection means on the outer surface of said housing, and strap means removably connected to said connection means for the purposes of carrying said device.

5. The toilet case of claim 4 wherein said strap connection means comprise two D-ring clips fastened to the housing on opposite sides of said toilet case such that said toilet will be carried in a vertical position.

6. The toilet of claim 1 further comprising cover means removably attached to said device.

7. The toilet case of claim 1 wherein said housing and said base portion surfaces are knurled to allow for better grip.

8. The toilet case of claim 1 further comprising mirror means fixedly attached to the base unit of the second storage unit.

9. The toilet case of claim 1 further comprising gasket means placed at all thread means to seal said toilet case and make said toilet case water-tight.

10. The toilet case of claim 1 further comprising:

a third storage unit, having a top portion, and also being cylindrical and being of similar design to said cap means, also having a threaded portion around the outer circumference of the top portion of said third unit such that said third unit can be connected to the top of the housing and said second storage unit can be mated to the top of the third storage unit;

B. portable stove means removably placed within said third storage unit.

* * * * *